US011932969B2

(12) United States Patent
Leitner et al.

(10) Patent No.: US 11,932,969 B2
(45) Date of Patent: Mar. 19, 2024

(54) MICROFIBER

(71) Applicant: LENZING AG, Lenzing (AT)

(72) Inventors: Johann Leitner, Haid (AT); Gert Kroner, Lenzing (AT); Egon Dünser, Timelkam (AT); Karin Kämpf, Eberschwang (AT); Harald Schobesberger, Ohlsdorf (AT); Roland Möslinger, Pattenfirst (AT)

(73) Assignee: Lenzing Aktiengesellschaft, Lenzing (AT)

( * ) Notice: Subject to any disclaimer, the term of this patent is extended or adjusted under 35 U.S.C. 154(b) by 0 days.

(21) Appl. No.: 14/620,833

(22) Filed: Feb. 12, 2015

(65) Prior Publication Data

US 2015/0159302 A1 Jun. 11, 2015

Related U.S. Application Data

(63) Continuation of application No. 12/812,156, filed as application No. PCT/AT2008/000432 on Dec. 5, 2008, now abandoned.

(30) Foreign Application Priority Data

Jan. 11, 2008 (AT) ..... A 47/2008
Apr. 17, 2008 (AT) ..... A 619/2008

(51) Int. Cl.
*D01F 2/24* (2006.01)
*D01F 2/06* (2006.01)
*D02G 3/04* (2006.01)

(52) U.S. Cl.
CPC ..... *D01F 2/24* (2013.01); *D01F 2/06* (2013.01); *D02G 3/04* (2013.01); *D10B 2201/20* (2013.01); *Y10T 428/249921* (2015.04); *Y10T 428/2904* (2015.01); *Y10T 428/2913* (2015.01); *Y10T 442/313* (2015.04)

(58) Field of Classification Search
CPC ..... D03D 15/00; D02G 3/02
See application file for complete search history.

(56) References Cited

U.S. PATENT DOCUMENTS

| | | | | | |
|---|---|---|---|---|---|
| 1,683,199 | A | | 9/1928 | Liliefeld | |
| 2,586,796 | A | | 2/1952 | Drisch et al. | |
| 3,114,747 | A | | 12/1963 | Parrish | |
| 3,126,435 | A | | 3/1964 | Tallis et al. | |
| 3,539,678 | A | * | 11/1970 | Keniti | D01F 2/08 264/188 |
| 3,670,069 | A | * | 6/1972 | Mitchell | D01F 2/08 264/210.4 |
| 3,785,918 | A | | 1/1974 | Kawai et al. | |
| 4,076,933 | A | * | 2/1978 | Turbak | C08B 5/00 264/183 |
| 4,364,889 | A | * | 12/1982 | Geyer, Jr. | D01F 2/06 264/188 |
| 4,468,428 | A | | 8/1984 | Early et al. | |
| 5,458,835 | A | | 10/1995 | Wilkes et al. | |
| 6,117,378 | A | | 9/2000 | Eibl et al. | |
| 6,153,136 | A | | 11/2000 | Collier et al. | |
| 6,197,230 | B1 | | 3/2001 | Pierre et al. | |
| 6,250,060 | B1 | | 6/2001 | Scheerer et al. | |
| 6,511,746 | B1 | | 1/2003 | Collier et al. | |
| 2002/0148050 | A1 | | 10/2002 | Luo et al. | |
| 2004/0058072 | A1 | * | 3/2004 | Rearick | A41D 31/00 427/324 |
| 2005/0056956 | A1 | | 3/2005 | Zhao et al. | |
| 2011/0200776 | A1 | | 8/2011 | Zikeli et al. | |

FOREIGN PATENT DOCUMENTS

| | | | | | |
|---|---|---|---|---|---|
| AT | 287905 | B | | 2/1971 | |
| AT | 408355 | B | | 11/2001 | |
| AT | 412654 | B | | 5/2005 | |
| AT | A472008 | | * | 1/2008 | D01F 2/06 |
| AT | A6192008 | | * | 4/2008 | D01F 2/06 |
| CN | 1418990 | A | | 5/2003 | |
| DE | 838936 | C | | 5/1952 | |
| DE | 19622476 | A1 | | 12/1997 | |
| DE | 19632540 | A1 | | 2/1998 | |
| EP | 1085113 | A2 | | 3/2001 | |
| FR | 2764910 | A1 | | 12/1998 | |
| GB | 310944 | A | | 8/1930 | |
| GB | 362460 | A | * | 11/1931 | D01F 2/06 |
| GB | 2081175 | A | * | 2/1982 | D01F 2/06 |
| GB | 2310630 | A | | 9/1997 | |
| JP | 58089924 | U | | 6/1983 | |
| JP | 2001-316934 | A | | 11/2001 | |
| JP | 2004-339650 | A | | 12/2004 | |
| JP | 2005187959 | A | | 7/2005 | |
| JP | 2005-273055 | A | | 10/2005 | |
| SU | 759627 | A1 | | 8/1980 | |
| TW | I293654 | B | | 2/2008 | |
| WO | 9858102 | A1 | | 12/1998 | |
| WO | 0186043 | A1 | | 11/2001 | |
| WO | 2005106085 | A1 | | 11/2005 | |

OTHER PUBLICATIONS

"Dynamics of Fibre Formation and Processing", Beyreuther, et al. (Year: 2006).*
Cellulose-Regenerated Cellulose Data by AZO Materials (Year: 2020).*
T. Roder et al. "Comparative Characterisation of Man-Made Regenerated Cellulose Fibres", Lenzinger Berichte, vol. 87, pp. 98-105 (2009).
"Terminology of Man-Made Fibres", Terminology BISFA, pp. 5, 10 (2009).
John Dyer and George C. Daul, "Rayon Fiber", Handbook of Fiber Science and Technology, vol. 4, pp. 983-984, 992 (1985).
Götze K., Chemiefasern nach dem Viskoseverfahren, 3rd Ed., 1967, vol. 1, pp. 670-673.
Lund and Waters, Text. Res. J., vol. 29:950-960 (1959).
(Continued)

*Primary Examiner* — Jennifer A Boyd
*Assistant Examiner* — Ricardo E Lopez
(74) *Attorney, Agent, or Firm* — Venable LLP

(57) ABSTRACT

The present invention relates to a high-tenacity cellulosic regenerated fiber with an individual fiber titer of between 0.6 and 0.9 dtex and yarns and planar textile structures which contain regenerated fibers of this kind.

15 Claims, No Drawings

(56) References Cited

OTHER PUBLICATIONS

H.K. Rouette, "Lexikon der Textilveredlung", vol. 2 pp. 1250.
CRC Handbook of Chemistry and Physics, D-240, (62nd ed.1982-1983).
https://en.wikipedia.org/wiki/Staple_(textiles).
Micromodalfasern—Von der Faser bis zum Fertigprodukt, 8. SVT—Kurs 2000, pp. 28-30, URL: http://www.mittex.ch/downloads/ausgabe2000/600/0620SVT.pdf [Downloaded Jul. 8, 2008].
Ruhrnossl, F., "Micromodal Fiber," SVT Forum, Micromodal Material—From Fiber to Finished Product, 8th SVT course 2000, mittex 6/00, pp. 28-30, URL: http://www.mittex.ch/downloads/ausgabe2000/600/0620SVT.pdf [Downloaded Jul. 8, 2008].

* cited by examiner

MICROFIBER

The present application is a continuation of U.S. patent application Ser. No. 12/812,156, filed Jul. 8, 2010, which is a national stage filing under 35 U.S.C. § 371 of International Patent Application No. PCT/AT2008/000432, filed Dec. 5, 2008, which claims priority to Austrian Patent Application No. A 47/2008 filed Jan. 11, 2008 and Austrian Patent Application No. A 619/2008 filed Apr. 17, 2008, the entire disclosure of each of which is incorporated by reference herein.

BACKGROUND OF THE INVENTION

1. Field of the Invention

The invention relates to a high-strength cellulosic regenerated fiber with a single fiber titer of between 0.6 and 0.9 dtex and yarns and planar textile structures which contain regenerated fibers of this kind.

2. Description of the Related Art

Today, above all, fibers according to the viscose process are known as cellulosic regenerated fibers and these are produced around the world. For standard applications in the textile and non-wovens sector, fibers are used with an individual fiber titer of between 0.9 and 16 dtex. Fibers with a smaller individual fiber titer are normally designated as microfibers whereby the expression "microfiber" generally designates fibers with a tire smaller than 1.0 dtex or, depending on the material density, with a diameter of 9 to 10 μm ("Lexikon der Textilveredlung", H. K. Rouette, 1995, Volume 2, p. 1250 ff; Laufman Verlag, Duelman). Moreover it is known that fabrics of microfibers are basically softer than those of coarser fibers.

Today consumers and the clothing industry place various demands on the wear comfort and the variety of design possibilities of textiles. In this respect it is among other things important that even thin and soft fabrics have a high strength and are resilient and dimensionally stable and that the appearance remains unchanged as far as possible after longer use. For this reason, it is no longer sufficient today to only process fibers with a small titer without paying attention to the fiber tenacity and above all to the fiber tenacity in a wet state.

At the same time it must also be possible to process fibers of this kind without any problems in the textile chain. Above all it must be made sure that the fibers have a high regularity and uniformity with regard to the titer and cut length.

Various methods are known from the literature to produce cellulosic microfibers. Some of these approaches range from standard viscose fibers, based on a cellulose xanthogenate solution.

The Russian patent SU 759627 suggests a spinning bath of organic acids in organic solvents for the production of viscose microfibers instead of watery diluted sulphuric acid by means of which it should be possible to produce fibers with up to 0.05 dtex. No details are provided with regard to the tenacity of the fibers produced in this way.

FR 2764910 claims a process in which the drawing is to be performed hydraulically instead of mechanically. Viscose fibers with a titer of 0.3 dtex are obtained. No details are provided concerning the tenacity of the fibers.

U.S. Pat. No. 6,197,230 and the references quoted in this suggests for production a mixture of fibers and microfibers, the spraying of the cellulose spinning solution by means of air, nitrogen or a water jet. The fibers obtained are mainly ultrafine and reveal much more irregular diameters. The result of this process is neither foreseen for textile applications nor does it appear suitable for this. No details are provided regarding the tenacity of these fibers.

U.S. Pat. No. 3,785,918 likewise reveals the production of a mixture of viscose fibers and microfibers whereby a spinning device is used according to the ejector principle. The microfibers obtained are to be used to produce paper. They are very non-uniform and thus not suitable for textile applications.

U.S. Pat. No. 4,468,428 discloses the production of viscose fibers with a diameter of 8 μm using a spinneret with spray hole diameters of 20 μm. Such spray hole diameters cannot be operated with sufficient production safety in large-scale technical operations since deposits form in a short space of time on the spinning bath side of the spray hole which has a detrimental effect on the regularity of the fiber diameter and the spinning safety and or the entire jet channel is blocked with particles of dirt and thus the fiber titer fluctuates to an even greater extent.

CN 1418990 discloses the production of ultrafine viscose fibers as a result of the special adjustment of the drawing forces and thus a tuned jet hole diameter. The fibers contained in this way reveal a titer of 0.56-0.22 dtex. The tenacity achieved of these fibers cannot be found in the document.

JP2005187959 suggests using pulp of Californian cedar to produce viscose staple fibers. In this way it should be possible to obtain fibers over a wide range of titers between 0.2 and 30 den which would also include microfibers. The range of between 1.5 and 10 den is, however, preferred i.e. outside the microfiber range. No indication is given of the fiber tenacity.

JP 58089924 discloses non-wovens of ultrafine fibers with a diameter of the individual fibers of 0.05-2 μm. The fibers can be produced using the viscose, cuprammonium or acetate process. It appears to be important that these can be burnt. Fine fibers of this kind are no longer suitable in particular for textile applications.

U.S. Pat. No. 3,539,678 describes a modified viscose process by means of which fibers are obtained with a "high wet modulus", so-called HWM fibers. These are to be produced in a titer range of 0.7 to 5.0 den. The samples contain only fibers with a titer of 1.0 den (corresponding to 1.1 dtex) with a dry tenacity of max. 2.93 g/den (corresponding to 25.9 cN/tex).

Apart from the viscose process, the state of the art suggests other as such well- known processes for the production of cellulosic microfibers:

GB 310944 reveals the production of filament yarns with an individual fiber titer of a maximum of 1 den using the cuoxam process. For example fibers can be obtained with 0.7 den and a dry tenacity of 2.64 g/den (corresponding to 23.3 cN/tex). The cuoxam process displays considerable environmental problems and is, therefore, no longer used around the globe except in one or two exceptions.

WO 98/58102 suggests a Lyocell process for the production of cellulose microfibers. At this junction it should be expressly emphasized that a Lyocell process does not lead to cellulose regenerated fibers in the sense of this application since in the Lyocell process, the cellulose is only physically dissolved and then precipitated whilst when producing cellulose regenerated fibers, a cellulose derivative is first produced for example cellulose xanthogenate or—as in the case of the cuprammonium process—a cellulose metal complex which is regenerated to pure, undissolved cellulose in the course of the process. As a result of using special pulps with a special molar mass distribution, which is for example attained by means of the electron irradiation of the pulp, fibers can be produced according to WO 98/58102 with an individual fiber titer of 0.3 to 1.0 dtex, preferably 0.8 to 1.0 dtex. Nothing is, however, disclosed about the fiber tenacities which can be obtained with this process and the production costs are increased as a result of the special pulp.

WO 2005/106085, US 2005/056,956, US 2002/148,050, WO 01/86043 and the references quoted in this describe various approaches for the production of cellulose microfibers as a result of modifying the Lyocell process using melt blowing or centrifuge spinning. However, the fibers obtained in this way reveal irregular tire and fiber length distributions so that they are not suitable for high-quality textile and technical applications. Compared to the usual Lyocell process, the processes demand a completely new spinning apparatus at the least.

DE 19622476 and DE 19632540 suggest mixing an amine oxide cellulose solution with a viscose desolvation medium and the subsequent influence of different shearing fields on this mixture. In so doing, however, irregular titer and fiber length distributions are likewise obtained so that these fibers are also not suitable for high-quality textile and technical applications. Nothing is revealed about the fiber tenacities which can be attained. Moreover, the process is extremely complex due to the handling required for the desolvation medium and cannot be carried out in a usual Lyocell production line.

U.S. Pat. No. 6,153,136 and U.S. Pat. No. 6,511,746 reveal the production of cellulose microfibers via a modified Lyocell process with a special design of the spinneret geometry which causes a phase separation between the cellulose and the solvent. Nothing is disclosed about the fiber tenacities which can be reached with this process.

To sum up the state of the art therefore, only reveals fine to ultrafine cellulosic fibers, which were made with processes which do not make sense either economically and/or ecologically, have no adequate tenacity and/or there are no details about this or they cannot be used for textile purposes as a result of their means of production. In actual fact, some publications disclose nothing more than the author's intention to be able to (also) produce fine cellulosic fibers.

Staple fibers can be processed to yarns using various spinning processes. These spinning processes reveal various advantages and disadvantages. The "classical" ring spinning process is known for its flexibility, to be able to process fibers of different fineness and fiber length. Depending on the respective raw material, ring spinning machines or modified ring spinning processes, such as for example the COMPACT and the SIRO process, are able to produce yarns of the highest fineness. In practice one can assume that ring yarns have to have at least 50 fibers in the yarn cross-section. One considerable disadvantage of the ring spinning process is, however, its low productivity which can be traced back to the technology of the ring spinning process. Due to the basic technological principles of the ring spinning process—the productivity of this spinning process is determined by the extent of the yarn twist and the spindle speed—the costs of yarn production increase significantly as the yarn fineness increases. The production of fine or very fine yarns using the ring spinning process is, therefore, extremely cost-intensive. The fineness of yarns is expressed as the yarn count. The higher the yarn count, the finer it is. In the metric measuring system, the yarn count is indicated as Nm ("number metric") and internationally also as Ne ("number English").

The rotor spinning process which has been well known since around 1970 is characterized by a much higher productivity compared to the ring spinning process. With yarns with a fineness of Ne 30 (Nm 50) one can assume that the productivity of modern rotor spinning machines exceeds the productivity of ring spinning machines by around the factor 6. Compared to the ring spinning process, the rotor spinning process reveals the following disadvantages due to the basic technological principles of yarn production:

a) the rotor spinning process requires a significantly higher fiber number in the yarn cross-section than the ring spinning process. In practice one can assume that a rotor yarn must have at least 100 fibers in the yarn cross-section.
b) rotor yarns reveal significantly lower yarn strengths than ring yarns of the same yarn fineness
c) analogous to the ring spinning process, the productivity of yarn production is determined by the speed of the rotor and the level of the yarn twist.

Due to the basic technological principles named above, the rotor spinning machines are, however, not able to produce fine yarns with the same fineness and strength as ring spinning machines In the Murata Vortex spinning process developed by Messrs. Murata (MVS process), which belongs to the category of air jet spinning processes, the productivity of the spinning process is significantly above the productivity of the ring and rotor spinning process. With yarns of a fineness of Ne 30 (Nm 50), the productivity of this spinning process is 2.5 times higher compared to rotor spinning. Compared to the ring spinning process, the productivity of this process is in fact higher by a factor of 15. Spinning processes on the basis of the Murata Vortex principle require around 75-80 fibers in the yarn cross-section. This means that this spinning system is able to spin much finer yarns than the rotor spinning process. The strength of the yarns made using the MVS process, is at a significantly higher level compared to rotor yarns.

Like the rotor spinning process, the MVS spinning process requires fibers with a tenacity which allows the production of yarns with yarn strengths which guarantee a high productivity when being further processed to knitted or woven fabrics.

The cellulosic microfibers described before are not suitable for processing in high-performance spinning processes due to their relatively low absolute fineness. For this reason it was not possible until now to produce super fine yarns from these fibers, which are required to produce the lightweight textiles of cellulosic fibers which are increasingly in demand on the market, using modern high-performance spinning processes.

SUMMARY OF THE INVENTION

Compared to this state of the art, the task was to make a cellulosic fiber available which satisfies today's demands for an economical and ecologically responsible production process as well as for enhanced wear comfort and the improved appearance of the articles of clothing made from this. Moreover, there was a need for extremely fine yarns which could be produced from fibers of this kind at favourable cost.

The solution to this task is a high-tenacity cellulosic regenerated fiber, which reveals an individual tire T (dtex) of between 0.6 and 0.9 and preferably between 0.6 and 0.8, a tenacity ($B_c$) in the conditioned state of $B_c$ (cN)≥$1.3\sqrt{T}+2T$ and a wet modulus ($B_m$) with an elongation of 5% in the wet state of $B_m$ (cN)≥$0.5*\sqrt{T}$. Preferably the fiber in accordance with the invention has a strength in relation to the fineness in the conditioned state of at least 34.5 cN/tex. The wet modulus in relation to the fineness of this fiber is preferably at least 5.6 cN/tex.

A tenacity of 50.00 cN/tex and a wet modulus of preferably 10.0 cN/tex are the upper limits of the properties in accordance with the invention.

The fiber in accordance with the invention can be produced in an analogous manner to the process described in AT 287905. However, the spinning parameters such as the spinning mass output per jet hole and the draw-off speed must be adapted in accordance with the desired individual fiber titer. Surprisingly it has been shown that the tenacity and modulus of the fibers in accordance with the invention are considerably higher than was to be expected from the details given in AT 287905.

The fiber in accordance with the invention is preferably in the form of a staple fiber i.e. it is cut to a standardized length in the course of the production process. Common cutting lengths for staple fibers for the textile area lie between approx. 25 and 90 mm. Only such a standardized length of all of the fibers allows for the non-problematic processing on the machines commonly used in the textile chain today with a high productivity.

The subject matter of the present invention is also a yarn of the fibers in accordance with the invention. A yarn of this kind is characterized by a higher softness compared to yarns of fibers with a coarser titer. Compared to yarns of the cellulosic microfibers known from the state of the art, the yarns in accordance with the invention reveal a higher strength. To have suitable properties for the respective application, a yarn like this in accordance with the invention can also contain fibers of another origin in addition to the fibers in accordance with the invention for example synthetic microfibers of polyester, polyamide or polyacrylic, other cellulosic fibers (e.g. cotton, in particular combed cottons, Lyocell, cupro, linen, ramie, kapok . . . ), fine fibers of animal origin such as alpaca, angora, cashmere, Mohair and various silks. This type of blend of different types of fiber is generally known as an intimate blend.

In particular it was surprising that yarns in accordance with the invention could be made using air jet spinning processes with a very high fineness. With the fibers in accordance with the invention, it is possible for the first time to exceed the previously known spinning limits of high-performance spinning processes. This applies equally to the rotor as well as the air jet spinning process and the Murata Vortex spinning process. In the MVS spinning process it is possible for the first time to produce yarns finer than Ne 80 (Nm 135) the yarn count of which allows for trouble-free further processing to textiles. In the rotor spinning process it becomes possible for the first time to spin yarns finer than Ne 65 as a result of using fibers according to the patent application. These yarns of a higher fineness also always display a lower number of thin parts and a higher yarn regularity than yarns of fibers with a coarser titer.

The preferred embodiments of the present invention are yarns, produced using the air spinning process, with a fineness of more than 50 Nm, preferably more than 85 Nm, and most preferably more than 100 Nm.

The yarn in accordance with the invention can comprise 100% cellulosic regenerated fibers or in addition at least one or a blend of several other fine fiber types of the types named above.

DETAILED DESCRIPTION OF THE INVENTION

Since it was shown that the fibers in accordance with the invention are particularly well suited to the production of high-quality, fine, soft textiles with particularly pleasant wear properties, blends with other types of fiber such as for example synthetic microfibers of polyester, polyamide or polyacryclic, other cellulosic fibers (e.g. cotton, in particular combed cottons, Lyocell, cupro, linen, ramie, kapok . . . ), fine fibers of animal origin such as alpaca, angora, cashmere, mohair, various silks are preferred for use.

With the MVS process so-called core yarns can also be produced, the inner "core" of which is made of another type of fiber in the form of an outer "shell". For example it is possible to produce a yarn with a core of endless filament of polyamide, polyester or elastane and a sheath of the fiber in accordance with the invention and thus to combine the mechanical and comfort properties of the two types of fibers.

Likewise a planar textile structure is the subject-matter of the present invention which contains the fibers in accordance with the invention. Apart from the fibers in accordance with the invention, the planar textile structure and the yarn in accordance with the invention can contain other fibers. The planar textile structure is preferably a woven or knitted fabric, and can however also basically be a non-woven. Likewise for high-quality non-wovens, the use of fibers of regular length and diameter and a high tenacity can be of decisive significance.

Since it has been seen that the fibers in accordance with the invention are particularly well suited to the production of high-quality, fine, soft textile structures with particularly pleasant wear properties, planar textile structures with a mass per unit area of less than 150 g/m2, in particular less than 115 g/m2, represent a preferred embodiment of the present invention. These can comprise 100% cellulosic regenerated fibers or in addition at least one other fine fiber type. For example with the fibers in accordance with the invention, woven shirt and blouse fabrics are possible with a mass per unit area of less than 100 g/m2 of yarns from high-performance processes such as the rotor or air jet spinning processes.

For the reasons named above, synthetic microfibers of polyester, polyamide or polyacrylic, other cellululosic fibers (e.g. cotton, particularly combed cotton, Lyocell, cupro, linen, ramie, kapok . . . ), fine fibers of animal origin such as Alpaka, angora, cashmere, Mohair and various silks, are the preferred blending partners for the production of the very finest yarns and textiles with a lighter weight.

Example 1

A cellulosic staple fiber produced according to AT 287905 in a commercial line with a titer of 0.8 dtex displayed, measured according to the BISFA regulations, a strength of 36.3 cN/Tex in the conditioned state and a modulus of 5.9 cN/tex (5% elongation).

Yarns containing 100% this fiber were produced using the air jet technology on a MVS spinning machine with Nm 100(Ne 60), Nm 135 (Ne80) and Nm 180 (Ne 100). They demonstrated a much higher softness than the yarn produced from the normal Lenzing Modal® fiber.

Moreover, the fiber in accordance with the invention from example 1 was spun as a comparison with the well-known ring spinning and siro processes to fine yarns Nm 180 (Ne. 100) (Tab. 1). It was clearly determined that the air jet yarns revealed a similar tenacity (breaking tenacity) and elongation (breaking elongation) to the ring and/or siro yarns which are known indeed for a high quality but for a much lower productivity.

| | | Spinning Process | | | | |
|---|---|---|---|---|---|---|
| | | MVS | MVS | MVS | Ring | Siro |
| Yarn count | Nm | 100 | 135 | 180 | 180 | 180 |
| | Ne | 60 | 80 | 100 | 100 | 100 |
| Breaking tenacity | cN//tex | 18.3 | 17.3 | 16.4 | 18.3 | 18.7 |
| Breaking elongation | EF (%) | 7.3 | 6.3 | 5.6 | 7.0 | 6.6 |

Knitted fabrics were made from MVS yarns in Nm 100 and/or Nm 135 with weights per unit area in the range of 100 and 125 g/m2. It was possible to produce these knitted fabrics without any difficulties and they revealed excellent useful properties.

Example 2

A cellulosic staple fiber also produced in a pilot plant in accordance with AT 287905 with a titer of 0.65 dtex revealed, measured using the BISFA regulations, a tenacity in the conditioned state of 36.4 cN/tex and a modulus (5% elongation) of 6.3 cN/tex. A yarn made of this fiber also revealed a much higher softness than the yarn made of conventional Lenzing Modal® fiber.

What is claimed is:

1. A high-tenacity cellulosic regenerated staple fiber with an individual fiber titer T between 0.6 and 0.9 dtex, wherein the generated fiber has a tenacity ($B_c$) in the conditioned state of $B_c(cN) \geq 1.3\sqrt{T}+2T$ and a wet modulus ($B_m$) with an elongation of 5% of $B_m$ $(cN) \geq 0.5*\sqrt{T}$, wherein the wet modulus is ≤10 cN/tex.

2. A yarn which comprises cellulosic regenerated fibers according to claim 1.

3. The yarn according to claim 2, produced using an air spinning process, wherein the yarn has a fineness of more than 50 Nm.

4. The yarn according to claim 2 or 3, comprising 100% cellulosic regenerated fibers.

5. The yarn according to claim 2, further comprising at least one other fiber type.

6. The yarn according to claim 5, wherein the at least one other fiber type is selected from the group consisting of synthetic microfibers, other cellulosic fibers, and fine fibers of animal origin.

7. A planar textile structure comprising cellulosic regenerated fibers according to claim 1.

8. The planar textile structure according to claim 7 having a weight per surface area of less than 150 g/m2.

9. The planar textile structure according to claim 7, comprising 100% cellulosic regenerated fibers.

10. The planar textile structure according to claim 7, comprising at least one other fiber type.

11. The planar textile structure according to claim 10, wherein the at least one other fiber type is selected from the group consisting of synthetic microfibers, other cellulosic fibers, and fine fibers of animal origin.

12. The yarn according to claim 6, wherein the synthetic microfibers are selected from the group consisting of polyester, polyamide and polyacrylic fibers.

13. The yarn according to claim 6, wherein the other cellulosic fibers are selected from the group consisting of cotton, combed cotton, Lyocell, cupro, linen, ramie, and kapok.

14. The yarn according to claim 6, wherein the fine fibers of animal origin are selected from the group consisting of alpaca, angora, cashmere, mohair and silks.

15. The planar textile structure according to claim 8 having a weight per surface area of less than 115 g/m2.

* * * * *